United States Patent [19]

Moe et al.

[11] Patent Number: 4,703,855

[45] Date of Patent: Nov. 3, 1987

[54] SYSTEM FOR STORING AND SHIPPING CONTAINERS

[76] Inventors: Lael A. Moe, 6440 W. 67th Ave., Arvada, Colo. 80003; Steven B. Manville, 7154 S. Dover Ct., Littleton, Colo. 80123

[21] Appl. No.: 851,949

[22] Filed: Apr. 14, 1986

[51] Int. Cl.[4] ..... B65D 71/00

[52] U.S. Cl. ..... 206/427; 206/459; 220/21; 229/120.36

[58] Field of Search ..... 53/398, 415; 206/427, 206/429, 459; 217/22, 30, 31; 220/21; 229/28 BC

[56] References Cited

U.S. PATENT DOCUMENTS

| | | | |
|---|---|---|---|
| 495,534 | 4/1893 | Vance | 217/22 |
| 643,057 | 2/1900 | Higham | 217/22 |
| 957,218 | 5/1910 | Klefeker . | |
| 1,995,482 | 3/1935 | Plautz . | |
| 2,261,164 | 11/1941 | Krauss . | |
| 2,330,671 | 9/1943 | Boh et al. . | |
| 3,383,027 | 5/1968 | Brinkama et al. . | |
| 3,416,694 | 12/1968 | Bebb | 220/21 |
| 3,767,106 | 10/1973 | Morgan . | |
| 3,912,159 | 10/1975 | Danville . | |
| 3,942,709 | 3/1976 | Gepfer . | |
| 4,187,975 | 2/1980 | Shepherd . | |
| 4,330,078 | 5/1982 | Graser | 228/28 BC |
| 4,335,842 | 6/1982 | Bradford et al. . | |
| 4,470,539 | 9/1984 | Skillen | 206/427 |

FOREIGN PATENT DOCUMENTS

| | | | |
|---|---|---|---|
| 3300590 | 7/1984 | Fed. Rep. of Germany | 220/21 |
| 704251 | 2/1954 | United Kingdom | 220/21 |

*Primary Examiner*—John Sipos
*Attorney, Agent, or Firm*—Klaas & Law

[57] ABSTRACT

A system for the storing and shipping of containers wherein a plurality of interlocked partitions divide an inner cavity of a carton into a plurality of compartments each of which is adapted to receive a container and wherein the largest cross-sectional configuration of the container is located within each compartment and which largest cross-sectional configuration includes a label secured to the container and wherein each compartment is provided with means ensuring that there is no contact between the label and at least a plurality of the sidewalls defining each compartment to protect the label from abrasion, tearing or other undesirable forces.

6 Claims, 4 Drawing Figures

SYSTEM FOR STORING AND SHIPPING CONTAINERS

FIELD OF THE INVENTION

This invention relates generally to the field of packaging containers, such as for beverages, for storage and shipping and more particularly to a carton for use in the storing and shipping of containers so as to provide protection against abrasion and/or tearing of labels affixed to the containers and more specifically to partitions for use in dividing the cartons into compartments provided with suitable means so that a container may be positioned in each compartment so that the label thereon is protected from abrasion, tearing or other similar undesirable forces.

BACKGROUND OF THE INVENTION

In the normal marketing of beverages, such as beer in a container, it is conventional to use some type of material for identification of the beverage contained in the container. In normal practice, a carton is provided with a plurality of interlocking partitions which provide sidewalls to divide the carton into a plurality of compartments, each of which is adapted to receive one container. One type of identification relates to the use of labels having identifying printing thereon which label is affixed to the outer surface of the container. Some containers contain a recess in the outer surface thereof which recess has dimensions so that a label may be positioned in the recess and be protected by the means defining the recess against contact with the sidewalls of the compartment during the storing and shipping of the containers in the carton. However, in those instances wherein there is no recess in the outer surface of the container, the label is affixed to the outer surface of the container so that the label projects outwardly therefrom. In this type of container, the label comes into contact with portions of the sidewalls of the compartment so as to subject the labels to forces tending to abrade or tear the labels. This is particularly true when the containers, such as bottles, are positioned in the compartments with wet labels and the cartons are moved before the wet labels have a chance to dry. Also, if the beverage in the container is relatively cold when placed in the compartment, there are condensation problems associated therewith.

BRIEF DESCRIPTION OF THE INVENTION

This invention provides a system for the storing and shipping of containers in a carton wherein the means forming the partitions used to divide the carton into a plurality of compartments are provided with means for the protection of the label on the containers from forces tending to subject the label to abrasion or tearing by ensuring that there is no contact between the label on the container and at least a plurality of the sidewalls of each compartment when each container is fully positioned in each compartment. In a preferred embodiment of the invention, each sidewall of the compartment is provided with means for ensuring no contact between the label and the sidewall.

In one embodiment of the invention, a carton is provided wherein the carton has a pair of opposed longitudinally extending relatively long sidewalls, a pair of opposed transversely extending relatively short sidewalls and a bottom wall, all joined together to form an inner cavity. A plurality of containers, each having a longitudinally extending axis, are provided wherein each of the containers has a body portion, a neck portion, a top and a bottom. Each body portion has a generally cylindrical outer surface. A label is secured to the generally cylindrical outer surface of the body portion with a top edge of the label spaced from the juncture of the body portion and the neck portion and a bottom edge of the label spaced from the bottom of the container. A plurality of relatively long longitudinally extending partitions are joined in an interlocking relationship with a plurality of relatively short transversely extending partitions and are positioned in the inner cavity of the carton so as to provide a plurality of compartments having sidewalls formed by the relatively long and relatively short partitions. A container having a label affixed thereon is positioned in each of the compartments. Each of the sidewalls of the compartment formed by the relatively long and relatively short partitions is provided with a slot extending in longitudinal direction parallel to the longitudinal axis of the container positioned in the compartment. The slot extends in the longitudinal direction for a linear distance greater than the linear extent between the top edge and the bottom edge of the label. When the container is fully positioned in a compartment, the top of the slot is above the top edge of the label and the bottom of the slot is below the bottom edge of the label. The slot has a width of sufficient extent so that the label will not contact the edges of the slot defining the width thereof when the portion of the generally cylindrical outer surface of the container between the top edge of the label and the junction of the body portion and the neck portion contacts the sidewall of the compartment above the slot or the portion of the generally cylindrical outer surface of the container between the bottom edge of the label and the bottom edge of the container contacts the sidewall of the compartment below the slot. In most instances, the label extends around the generally cylindrical outer surface of the body portion in a circumferential direction for about 180 degrees. This means that when a container is positioned in a compartment, at least two spaced apart portions of the label will be radially opposite the slots in the associated sidewalls of the compartment. In response to external forces applied to the carton during handling or shipping a portion of the outer surface of the body portion between the top edge of the label and the juncture of the body portion and the neck portion may move into contact with the adjacent sidewall of the compartment. Also, a portion of the outer surface of the body portion between the bottom edge of the label and the bottom of the container may move into contact with the adjacent sidewall of the compartment. As explained above, because of the location of the slot, there will be no contact between the label and any portion of an adjacent sidewall of the compartment.

It is noted that the compartments formed adjacent to the longitudinally extending relatively long sidewalls and the transversely extending relatively short sidewalls of the carton will have some sidewalls that are not provided with slots. However, even these compartments will have at least a plurality of sidewalls formed with slots. If necessary, the carton could be made larger and relatively long longitudinally extending partitions and relative short transversely extending partitions, all provided with slots, could be positioned adjacent to the longitudinally extending relatively long sidewalls and the transversely extending relatively short sidewalls of the carton.

It is an object of this invention to provide a system for the storing and shipping of containers so as to minimize the abrasive or tearing forces capable of being applied to the labels on the containers.

It is another object of this invention to provide a system for packaging containers in a carton for storing and shipping which carton has a plurality of compartments provided therein and wherein each of the sidewalls forming each of said compartments has portions thereof in contact with portions of a container positioned fully in each compartment but has no contact with a label on the container positioned therein.

Additional objects, advantages, and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

DETAILED DESCRIPTION OF THE INVENTION

Figure 1:
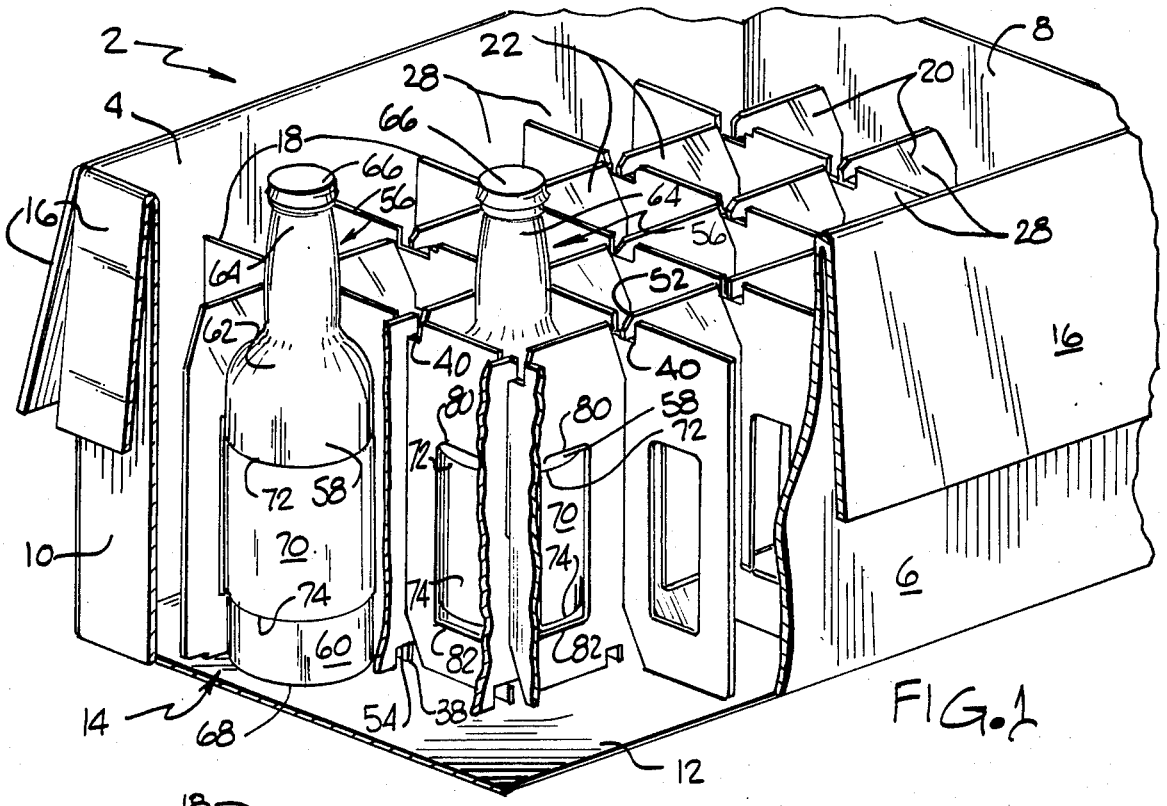
FIG. 1 is a pictorial representation of one embodiment of the invention.

In FIG. 1, there is illustrated a preferred embodiment of this invention comprising a carton 2 having a pair of opposed longitudinally extending relatively long sidewalls 4 and 6, a pair of opposed transversely extending relatively short sidewalls 8 and 10 and a bottom wall 12, all of which are joined together to form an inner cavity 14. As illustrated in FIG. 1, the carton 2 is also provided with a plurality of flaps 16 hingedly connected to the sidewalls 4, 6, 8 and 10 so that they may be folded over to form a top wall (not shown). The provision of the flaps 16 is optional and the carton 2 may be formed without the flaps 16 so as to having a permanently open top.

A plurality of relatively short transversely extending partitions 18 are joined together, as described below, in an interlocking relationship with a plurality of relatively long longitudinally extending partitions 20. As illustrated in FIG. 1, interlocked partitions 18 and 20 are inserted into the inner cavity 14 of the carton 2 so as to provide a plurality of compartments 22 in the carton 2. The sidewalls of each compartment 22 are formed by opposed panels 24 of adjacent relatively short transversely extending partitions 18 and opposed panels 26 of adjacent relatively long longitudinally extending partitions 20. The partitions 18 and 20 also cooperate with the pair of opposed longitudinally extending relatively long sidewalls 4 and 6 and the pair of opposed transversely extending relatively short side walls 8 and 10 to form a plurality of compartments 28. As illustrated in FIG. 1, there are five relatively short transversely extending partitions 18 interlocked with three relatively long longitudinally extending partitions 20 and positioned in the inner cavity 14 so as to form eight compartments 22 and sixteen compartments 28. Although the preferred embodiment is illustrated as having an oblong rectangular cross-sectional configuration, it is understood that other cross-sectional configurations, such as a square, are within the concepts of this invention. Also, the compartments 22 and 28 may have cross-sectional configuration differing from the square cross-sectional configuration of the preferred embodiment.

Figure 2:
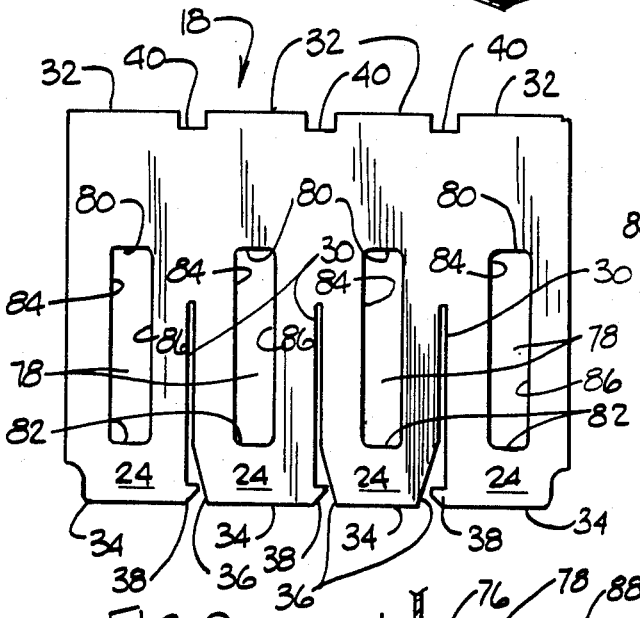
FIG. 2 is a side elevational view of a relatively short transversely, extending partition of FIG. 1.

One of the relatively short transversely extending partitions 18 is illustrated in FIG. 2 and comprises an integral unit having four contiguous panels 24 partially separated by downwardly opening slots 30. Each slot 30 extends for a linear distance equal to about one-half of the linear distance between the top edge 32 and the bottom edge 34 of each panel 24. A short distance from the bottom edge 34, each slot 30 diverges from the center of the slot 30 to provide an access opening 36 to each slot 30. A locking member 38 extends from the other side of each slot 30 and extends part way across the access opening 36. The upper edges 32 are provided with a plurality of upward openings rectangular notches 40. The centerline of each notch 40 is in alignment with the centerline of each slot 30.

Figure 3:
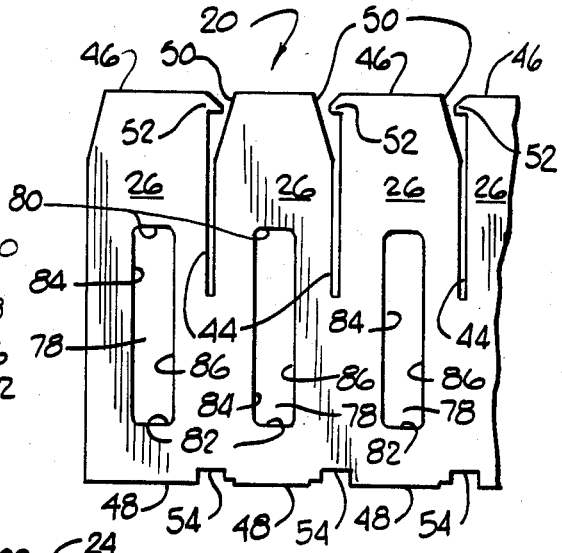
FIG. 3 is a side elevational view of a portion of a relatively long longitudinally extending partition of FIG. 1.

A portion of one of the relatively long longitudinally extending partitions 20 is illustrated in FIG. 3 and comprises an integral unit having six contiguous panels 26 partially separated by upwardly opening slots 44. Each slot 44 extends for a linear distance equal to about one-half of the linear distance between the top edge 46 and the bottom edge 48 of each panel 26. A short distance from the top edge 46, each slot 44 diverges from the center of the slot 44 to provide an access opening 50 to each slot 44. A locking member 52 extends from the other side of each slot 44 and extends part way across the access opening 50. The bottom edges 48 are provided with a plurality of downwardly opening rectangular notches 54. The centerline of each rectangular notch 54 is aligned with the centerline of each slot 44.

The relatively short transversely extending partitions 18 are assembled in interlocking relationship with the relatively long longitudinally extending partitions 20. The access openings 36 are placed over the access openings 50 and the two partitions 18 and 20 are pressed together until the tops of the downwardly opening slots 30 engage the bottoms of the upwardly opening slots 44. The locking members 38 at the access openings 36 are in the downwardly opening notches 54 and the locking members 52 are in the upwardly opening notches 40. This procedure is repeated until all of the relatively short transversely extending partitions 18 have been interlocked with the relatively long longitudinally extending partitions 20. The interlocked partitions 18 and 20 are then inserted into the inner cavity 14 of the carton 2.

Figure 4:
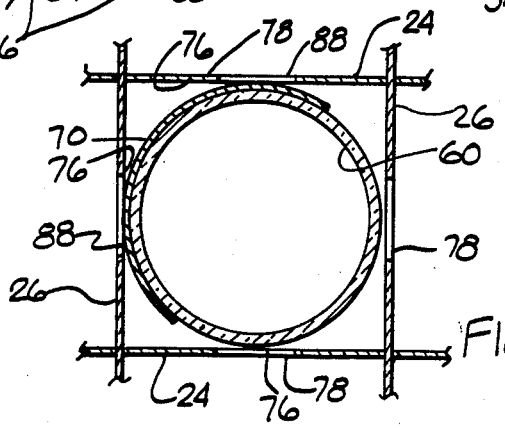
FIG. 4 is a cross-sectional view of a container positioned in a compartment formed by the partitions of FIGS. 2 and 3.

In the preferred embodiment of the invention, a container 56 is positioned in each of the compartments 22 and 28, only two of which are illustrated in FIG. 1. The container 56 comprises a body portion 58 having a generally cylindrical outer surface 60 and a cross-sectional configuration which has a cross-sectional area greater than any other cross-sectional area of the container 56. A neck portion 62 is contiguous to and integral with the body portion 58 and terminates in a top 64 to which is secured a cap 66 in sealing engagement therewith. A bottom 68 is also contiguous to and integral with the body portion 58. A label 70 is secured to the generally cylindrical outer surface 60 of the body portion 58. The label 70 has a top edge 72 extending generally parallel to and spaced from the juncture of the body portion 58 and the neck portion 62. The label 70 has a bottom edge 74 extending generally parallel to and spaced from the juncture of the bottom 68 and the body portion 58. In the embodiment illustrated in FIGS. 1 and 4, the label 70 extends in a circumferential direction for about 180 degrees. However, it is understood that the circumferential extent of the label 70 is optional including extending in a circumferential direction completely around the generally cylindrical outer surface 60. The label 70 projects outwardly from the generally cylindrical outer surface 60 of the body portion 54 for a distance equal to the thickness of the label 70 and the means securing the label to the generally cylindrical outer surface 60. As illustrated in FIG. 4, the diameter of the generally cylindrical outer surface 60 of the body portion 56 is slightly smaller than the linear distance between opposed sidewalls 24 and 26 of each compartment so that when the container 56 is centered in each compartment, there exists a space 76 between the generally cylindrical outer surface 60 and the adjacent sidewall 24 or 26. Conventional apparatus is used to load the containers 56 into the carton 2 so that when the containers 56 are originally fully positioned in each compartment 22 or 28, each container is centrally positioned as illustrated in FIG. 4.

Immediately after the containers 56 have been positioned in the compartments 22 and 28, the carton 2 is moved by appropriate means, such as a conveyor belt (not shown) for further processing. This movement of the carton 2 produces forces on each container 56 tending to move each container 56. The movement of the container 56 is stopped by contact between the generally cylindrical outer surface 60 of the body portion 58 and an at least one adjacent sidewall 24 or 26 of the compartments 22 and 28. In fact, the movement may be of such a nature, that the generally cylindrical outer surface 60 will be moved into contact with each of the sidewalls 24 and 26. In normal circumstances, such as the movement on the conveyor or subsequent handling for shipping and storage, the movement of the container 56 in each of the compartments 22 and 28 is such that the generally cylindrical outer surface 60 will at some time or another contact each of the sidewalls 24, 26, 4, 6, 8 or 10 defining the compartments 22 or 28. In view of this movement of the containers 56, it is desirable to protect the label 70 on each container 56 from contacting at least the sidewalls 24 and 26 of each compartment 22 and 28 so as to protect the label 70 from abrasive or tearing forces. This need for protection of the labels is particularly significant in those instances wherein the containers 56 are positioned in the compartments 22 and 28 when the labels 70 are still wet. Also, this protection is significant when the containers 56 are positioned in the compartments 22 and 28 are filled with a chilled beverage since condensation may form on the labels.

In accordance with a preferred embodiment of this invention, the above described protection is provided by forming a centrally located slot 78 in each of the panels 24 of the relatively short transversely extending partitions 18 and in each of the panels 26 of the relatively long longitudinally extending partitions 20. Each slot 78 has a linear extent between a top edge 80 and a bottom edge 82 thereof which is greater than the linear extent of the label 70 between the top edge 72 and the bottom edge 74 thereof. As illustrated in FIG. 1, when the container 56 is fully positioned in each compartment 22 or 28, the top edge 72 of the label 70 is below the top edge 80 of the slot 78 and the bottom edge 74 of the label 70 is above the bottom edge 82 of the slot 78. In order to preserve the strength of each panel 24 and 26 to a maximum, it is desirable to keep the width of the slot 78 between the side edges 84 and 86 to a minimum. The minimum width of the slot 78 is illustrated in FIG. 4 and is a width greater than the linear extent of a chord of the label 70 which chord is tangent to the generally cylindrical outer surface 60 of the body portion 58 at its point of contact with the panel 24 or 26 of each compartment 22 or 28. Since the point of contact between the generally cylindrical outer surface 60 and the panel 24 or 26 will vary on either side of the centerline of the slot 78, the minimum width of the slot 78 must be sufficiently great to accommodate this variance so that there will be no contact between the label 70 and the side edges 84 and 86 of each slot 78. Therefore, in operation, if the container 56 is subject to forces tending to move the containers 56 so that the generally cylindrical outer surface 60 is moved into contact with a panel 24 or 26, the width of the slot 78 will prevent contact between the label 70 and the side edges 84 and 86 of the slot and the linear extent and location of the top edge 80 of the slot 78 relative to the top edge 72 of the label 70 and the bottom edge 82 of the slot 78 and the bottom edge 74 of the label 70 will prevent contact between the label 70 and either panel 24 or 26.

In the embodiment of the invention illustrated in FIG. 1, it is noted that the sidewalls of each compartment 28 formed by portions of the longitudinally extending relatively long sidewalls 4 and 6 and by portions of the transversely extending relatively short sidewalls 8 and 10 are not provided with slots or other means so that the labels 70 will not contact these sidewalls. If such protection is desired, relatively short transversely extending partition 18 could be positioned adjacent to and in contact with each transversely extending relatively short sidewall 8 and 10. Also, a relatively long longitudinally extending partition 20 could be positioned adjacent to and in contact with each of the longitudinally extending relatively long sidewalls 4 and 6. In this manner, all of the sidewalls of the compartments 28 would be provided with slots 78.

In one embodiment of the invention, the inner cavity 14 of a carton 2 has a length of about 15 3/16 inches and a width of about $10\frac{1}{8}$ inches. Each relatively short transversely extending partition 18 has length of about 9 11/16 inches, a height of about $6\frac{1}{2}$ inches and a wall thickness of about 0.040 inch. Each relative long longitudinally extending partition 20 has length of about $14\frac{3}{4}$ inches, a height of about $6\frac{1}{2}$ inches and a wall thickness of about 0.40 inch. Each compartment 22 has a cross-sectional configuration which is square with each sidewall having a linear extend of about 2.491 inches. Each container has a generally cylindrical outer surface 60 having a diameter between about 2.375 and 2.484 inches and an overall height of between about 9.457 and 9.563 inches. Each label 70 has a thickness of between about 0.002 and 0.003 inch. Each slot 78 has a length of about $3\frac{3}{8}$ inches and a width of about $0\frac{5}{8}$ inch with the bottom 8 of the slot 82 of the slot being spaced about $0\frac{7}{8}$ inch above the bottom of each partition 18 and 20. The bottom edge 74 of the label 70 is about $1\frac{1}{8}$ inches above the bottom 68 of the container and the top edge 72 of the label 70 is about $3\frac{1}{8}$ inches above the bottom 68 of the container.

It is contemplated that the inventive concepts herein described may be variously otherwise embodied and it is intended that the appended claims be construed to include alternative embodiments of the invention except insofar as limited by the prior art.

What is claimed is:

1. A system for storing and shipping of containers each of which has a body portion having a cylindrical outer surface, a relatively narrow neck portion and a top portion and a bottom portion and with a label secured at least to a central portion of the body portion so that portions of the cylindrical outer surface are between the label and the neck portion and the label and the bottom portion so that the system protects the label from abrasive forces comprising:

a carton having at least a first pair of opposed sidewalls extending in one direction, a second pair of opposed sidewalls extending in a direction perpendicular to said first pair of opposed sidewalls and a bottom wall of which are joined together to form an inner cavity for said carton;

a first plurality of partitions located within said cavity, extending in a direction parallel to said one direction of said first pair of opposed sidewalls, and supported by said bottom wall;

a second plurality of partitions located within said cavity, extending in a direction perpendicular to said first plurality of partitions, and supported by said bottom wall;

said first plurality of partitions and said second plurality of partitions being joined together in an interlocking relationship to form a plurality of compartments having sidewalls formed by portions of said second plurality of partitions and portions of said second plurality of partitions with one container being located in each of said compartments so that the greatest cross-sectional configuration of said container in said compartment comprises a cross-sectional configuration including said label;

said compartments having opposed sidewalls spaced apart a linear distance greater than the cross-sectional configuration of the container and label so that a container may be inserted into each compartment without contacting the sidewalls thereof.

said sidewalls of said compartments having a length greater than the length of said body portion;

an opening formed in each of said sidewalls of said compartments formed by said first and second partitions;

said opening having a length substantially less than said length of said sidewalls but greater than the length of said label in the same direction; and said opening having a width substantially less than the width of said sidewall but great enough so that when said cylindrical outer surface of said body portion of said container above and below said label contacts other portions of one sidewall of said compartment above and below said opening said label will not contact any portion of said one sidewall.

2. A system as in claim 1 and further comprising:

said carton having a longitudinal extent greater than its transverse extent.

3. A system as in claim 2 wherein:

said first pair of opposed sidewalls are longitudinally extending and relatively long;

said second pair of opposed sidewalls are transversely extending and relatively short;

said first plurality of partitions are relatively long and longitudinally extending; and said second plurality of partitions are relatively short and transversely extending.

4. A package as in claim 3 wherein:

said label extends for a substantial distance in a circumferential direction around said cylindrical outer surface.

5. A package as in claim 4 wherein:

said label extends in a circumferential direction completely around said cylindrical outer surface.

6. A package as in claim 1 wherein:

said labels are wet when said containers are inserted into said compartments.

* * * * *

UNITED STATES PATENT AND TRADEMARK OFFICE

CERTIFICATE OF CORRECTION

PATENT NO. : 4,703,855

DATED : November 3, 1987

INVENTOR(S) : Lael A. Moe; Steven B. Manville

It is certified that error appears in the above-identified patent and that said Letters Patent is hereby corrected as shown below:

Claim 1, Column 7, line 20, "of which" should read --all of which--.

Claim 1, Column 7, line 34, "second plurality" should read --first plurality--.

Signed and Sealed this

Twenty-second Day of March, 1988

*Attest:*

DONALD J. QUIGG

*Attesting Officer*

*Commissioner of Patents and Trademarks*